United States Patent [19]

Frasier

[11] Patent Number: 4,487,246

[45] Date of Patent: Dec. 11, 1984

[54] SYSTEM FOR LOCATING CORES IN CASTING MOLDS

[75] Inventor: Donald J. Frasier, Whitehall, Mich.

[73] Assignee: Howmet Turbine Components Corporation, Greenwich, Conn.

[21] Appl. No.: 367,270

[22] Filed: Apr. 12, 1982

[51] Int. Cl.[3] ..... B22D 33/04

[52] U.S. Cl. ..... 164/32; 164/361; 164/516

[58] Field of Search ..... 164/30–32, 164/122.1, 122.2, 397–400, 340, 11, 34–36, 361, 516

[56] References Cited

U.S. PATENT DOCUMENTS

| | | | |
|---|---|---|---|
| 1,089,001 | 3/1914 | Lindberg | 164/398 |
| 1,657,444 | 1/1928 | Prince | 164/30 |
| 1,867,862 | 7/1932 | Moore | 164/366 |
| 2,049,886 | 8/1936 | Angell et al. | 164/398 |
| 2,096,679 | 10/1937 | Gibson | 164/399 |
| 2,688,781 | 9/1954 | Fahlberg et al. | 164/349 |
| 2,985,930 | 5/1961 | Hohlfelder | 164/398 |
| 3,401,738 | 9/1968 | Parille | 164/353 |
| 3,596,703 | 8/1971 | Bishop et al. | 164/132 |
| 3,659,645 | 5/1972 | Rose | 164/353 |
| 3,662,816 | 5/1972 | Bishop et al. | 164/366 |

FOREIGN PATENT DOCUMENTS

| | | | |
|---|---|---|---|
| 568678 | 1/1959 | Canada . | |
| 470283 | 1/1929 | Fed. Rep. of Germany . | |
| 1306304 | 9/1962 | France . | |
| 1219527 | 1/1971 | United Kingdom . | |
| 606676 | 5/1978 | U.S.S.R. | 164/30 |
| 668767 | 7/1979 | U.S.S.R. | 164/398 |

*Primary Examiner*—Kuang Y. Lin

*Attorney, Agent, or Firm*—McDougall, Hersh & Scott

[57] ABSTRACT

A method and a support structure for use in casting metal articles which define at least one internal passage and wherein the support structure is associated with a core or cores employed during the casting operation. In that operation, the cores are confined within a disposable pattern, and a ceramic mold is formed around the pattern. When the pattern material is removed, a mold cavity is provided with the core positioned in the cavity to form the desired opening in the cast article. The support structure for the core comprises a member positioned between the core surface and the opposing mold surface. This member is encompassed by the pattern material when the pattern material is formed around the core. During the subsequent removal of the pattern material and also during curing of the ceramic mold, the support member serves to hold the core in place so that the dimension of the casting wall surrounding the internal passage can be precisely maintained. The support is of a material which will be diffused into the casting alloy so that the casting properties will not be adversely affected. Furthermore, no significant surface finishing operations are required for the casting.

15 Claims, 8 Drawing Figures

SYSTEM FOR LOCATING CORES IN CASTING MOLDS

BACKGROUND OF THE INVENTION

This invention relates to investment casting operations and, more specifically, the invention relates to a method and means for supporting cores and the like during formation of such castings. The supporting function is particularly intended to guard against core movement or shifting which can occur in the various stages of the operation.

Investment casting procedures are frequently employed for the production of castings having one or more internal passages. Turbine blades and vanes comprise examples of cast articles defining hollow interiors which function to provide cooling for the blades or vanes during use.

In order to provide the internal passages, it is necessary to use cores which are usually of ceramic composition. Typically, the cores have "prints" which extend beyond the pattern portion defining the wall of the article to be cast so that these "prints" will be embedded in the ceramic material employed for forming the casting mold. When the metal is introduced into the mold cavity, the supported ends will tend to prevent displacement of the core which would result in improper location for the passage to be formed. For example, if a core is bent when encountering molten metal being introduced into a mold, the thickness of the wall which separates the casting exterior from the internal passage may become intolerably small.

As the performance requirements for turbine blades and vanes have increased, the cooling requirements, and thus the type of passages formed in such articles, have become more complex. The result is that the support for cores provided by the surrounding mold has been found to be inadequate since even small deviations of the core from its preferred position can lead to reject parts. In addition, it has been found that the deviation of cores from a desired location can occur during pattern removal, during curing of ceramic molds, and at elevated temperature preheating of ceramic molds.

Core displacement during casting is more likely where castings are formed as single crystals or by processes involving directional solidification. In those cases, there is a more gentle introduction of molten metal, but the mold containing the core is at elevated temperature when the metal is poured, and the mold is kept in this condition for a long period of time. The disturbance of the core position during pattern removal and mold curing is, of course, also a factor.

Various attempts have been made to provide means for supporting cores independently of the support provided by a mold. Chaplets such as described in Gibson U.S. Pat. No. 2,096,697 represent well-known prior art core supporting techniques. Other techniques specifically developed for use in connection with ceramic molds are set forth in Bishop U.S. Pat. No. 3,596,703 and Rose U.S. Pat. No. 3,659,645. It will be clear from a review of this prior art, however, that the primary concern involves the disturbance of core position as the metal is being poured. Core displacement during pattern removal, during mold curing and during mold preheating is not discussed.

Such prior systems have also failed to deal with the problems associated with the positive metal left on the casting surfaces by chaplet prints in the mold. These problems include but are not limited to finishing, dimensional control, inclusion control, nucleation and recrystalization. Specifically, the prior arrangements have utilized chaplets and the like which extended into the ceramic material of the mold, and the space occupied by such material was filled with cast material as the chaplet or other support dissolved in the course of the casting operation. This left protuberances on the cast surface which had to be removed by a finishing operation.

SUMMARY OF THE INVENTION

In accordance with this invention, core supports are associated with a core or cores in a pattern die. The pattern material is introduced into the die so as to surround the core and the associated supports. In the usual fashion, core pieces extend beyond the die cavity so that these core pieces will be embedded in the ceramic material which is formed around the pattern after removal of the pattern from the die.

During the subsequent pattern removal, the core supports serve to support the core against displacement. Similarly, during curing of the ceramic mold, and at elevated temperature preheat the core supports remain in place so that thermal stresses imposed on the core elements can be offset by the core supports and thus core displacement is eliminated or minimized.

The core supports are preferably metal with a melting point above the melting point of the metal being cast. This provides support for the cores during the remaining stages of the casting operation such as mold preheating, however, the support material will quickly diffuse into solution when the molten metal is poured into the mold.

When the casting has solidified, the core supports do not leave any protuberances on the cast surface. Accordingly, it is not necessary to conduct finishing operations designed to remove such irregularities and, as noted, other casting defects are also avoided.

DETAILED DESCRIPTION OF THE DRAWINGS

Figure 1:
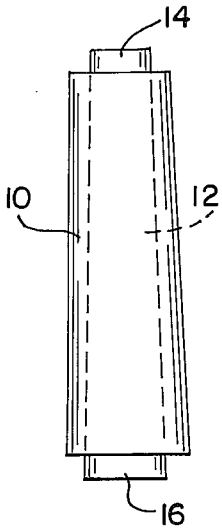
FIG. 1 is an elevational view of a pattern and core combination of conventional design.

FIG. 1 is intended to serve as a general illustration of a pattern and core combination of the type typically used in the relevant casting art. The pattern 10 may comprise a wax or other heat disposable material of conventional composition. The core 12 ordinarily comprises a ceramic member which will withstand the molten metal temperature and other casting conditions typically encountered when producing castings having internal passages. It will be appreciated that the core 12 will have (in the area encompassed by the pattern) dimensions corresponding with the desired dimension of the internal passage to be formed in a casting.

The ends 14 and 16 of the core are exposed to provide support for the core during the casting operation. Thus, in accordance with conventional practice, the assembly of FIG. 1 will be exposed to a dip coating for the formation of a ceramic shell mold around the assembly. The ceramic material will cover the core ends 14 and 16 so that after removal of the pattern material, the core will be held in place at its ends by the mold.

Figure 2:
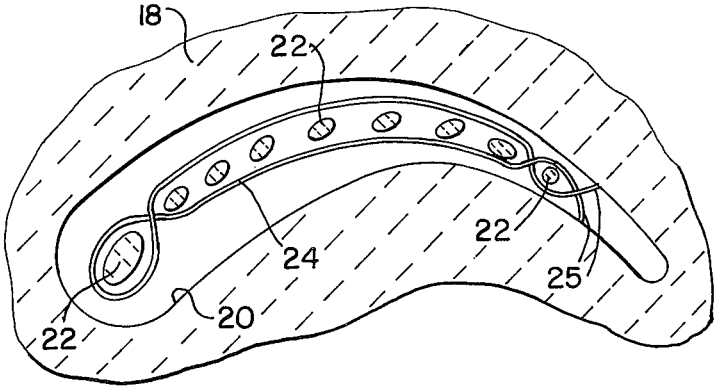
FIG. 2 is a cross-sectional view of a ceramic mold illustrating cores and core supports in a mold cavity.
Figure 3:
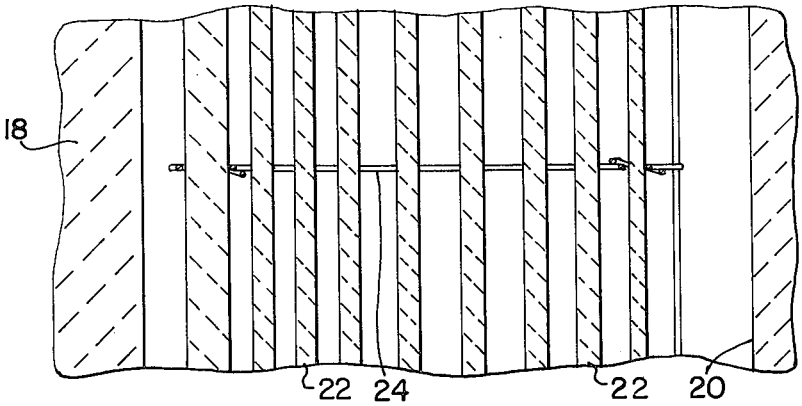
FIG. 3 is a fragmentary, vertical, elevational view of the structure shown in FIG. 2.

FIGS. 2 and 3 illustrate a ceramic mold 18 defining mold cavities 20. In this instance, a plurality of core elements 22 are positioned within the mold cavity, and it is contemplated that these core elements will be supported at their ends by the mold in the fashion described with respect to FIG. 1. These core elements are, however, of relatively small cross-sectional dimension, and are quite long relative to this cross section. It will, therefore, be appreciated that when these cores are subjected to certain operating conditions, there will be a tendency for the cores to bow or be otherwise distorted relative to the adjacent mold cavity surfaces. Obviously any displacement of a core element relative to the mold surface will result in a change in the thickness of the casting wall surrounding the internal passage developed by the core. Due to the necessity for precision control of such wall thicknesses, a high rejection rate can develop where such displacement of core elements occurs.

In accordance with the embodiment of the invention shown in FIGS. 2 and 3, a support 24 is provided for core elements 22. In this instance, the support consists of a wire which is woven about the end core elements, and which extends adjacent the remaining core elements on either side thereof.

In the practice of the invention, the core elements will be located in a pattern die with the support 24 positioned as shown. The injection of wax or other pattern material will serve to embed the wire 24 within the pattern, and the combination will then be ready for application of the dip coats conventionally used for forming a shell mold.

After formation of the shell mold, the mold is heated sufficiently to achieve pattern removal. The support 24 will serve during this stage of the operation to minimize or eliminate deflection of the slender cores 22. Subsequently, the mold is cured at an elevated temperature in accordance with conventional practice, and the support 24 will again serve to minimize or eliminate deflection which might otherwise be caused by handling or thermal stresses. It will be appreciated that for purposes of clearly illustrating the support 24, the support is shown spaced from the cores 22. In practice, the wire forming the support is woven rather closely into contact or near contact with the cores, and at least ends 25 engage the cavity walls. As will be more apparent when considering alternative embodiments, other portions of the wire may be bent outwardly to engage the mold cavity wall to provide additional support.

Subsequent casting operations involve introduction of molten metal into the mold cavity 20. The support 24 is preferably formed from metal having a melting point above the melting point of the material being cast. Particularly since the wire or other support employed will be of quite small dimension, the support will quickly diffuse into solution with the identity of the support material being completely or substantially lost insofar as the ultimate casting is concerned.

The use of platinum, or platinum group metals such as rhodium, palladium, iridium, osmium and ruthenium, for forming the supports of this invention is particularly contemplated. Other metallic elements as well as alloys compatible with the cast material are also contemplated. In the latter connection, various superalloys which would be compatible with the alloys employed for casting turbine blades and vanes are contemplated.

Figure 4:
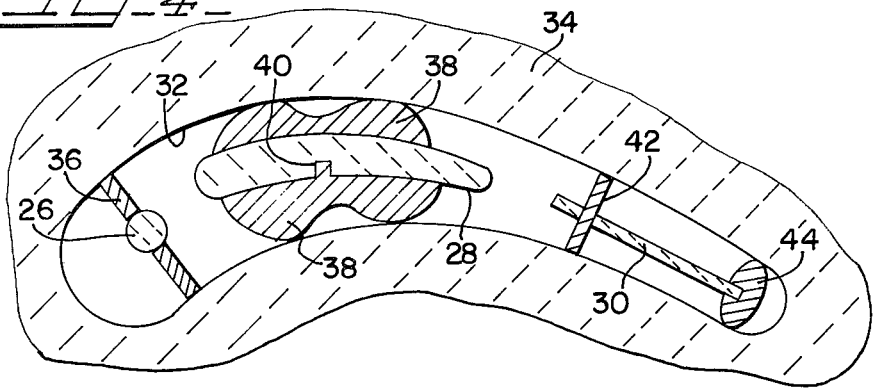
FIG. 4 is a cross-sectional view of a ceramic mold illustrating alternative forms of cores and core supports.

FIG. 4 illustrates a variation of the invention wherein cores 26, 28 and 30 are supported in the mold cavity 32 of ceramic mold 34. The core 26 is supported by a support 36 which extends between opposing mold wall surfaces. It will be appreciated that this support will substantially prevent deflection of the core 26 in any direction.

The support 38 for core 28 includes a detent 40 which extends within a corresponding opening defined by the core 28. This combination insures positioning of the support 38 at an appropriate location along the length of the core 28. Furthermore, this manner of attaching the support to the core insures against dislodging of the support when the various forces and stresses are encountered during subsequent operations. Since the support 38 will go into solution during casting, the area occupied by the detent 40 will be filled with cast material and provide a corresponding detent on the surface of the internal passage of the casting. This detent could be removed; however, the detent will normally not play any role in the operation of the cast article and may, therefore, remain in place.

The core 30 is shown supported at opposite edges by independent supports 42 and 44. It will thus be appreciated that any core which is subject to deflection across its width in addition to deflection along its length can be provided with sufficient support to avoid dimensional discrepancies.

The supports 36, 38, 42 and 44 may have longitudinal dimensions in the order of the wire support 24 shown in FIG. 3. Thus, the primary purpose of the supports is to avoid core movement toward and away from mold walls and even point contact by a support will be sufficient to achieve this purpose. The wire 24 may typically have a diameter of 0.020 inches and the width and longitudinal dimensions of the supports shown in the other figures may be of that order of magnitude.

Figure 5:
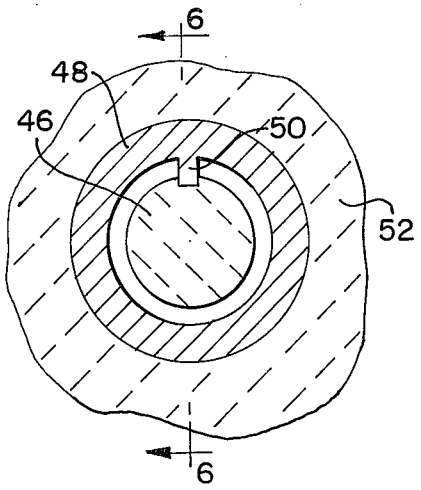
FIG. 5 is a cross-sectional view of a mold illustrating another alternative form of a core and core support.
Figure 6:
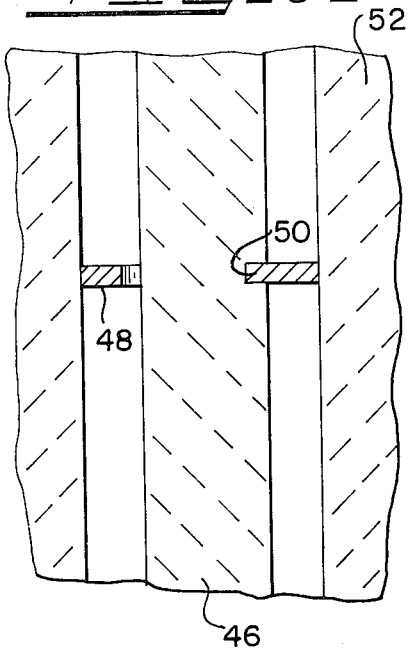
FIG. 6 is a fragmentary vertical, elevational view taken about the line 6—6 of FIG. 5.

FIGS. 5 through 8 show additional variations of the concepts of this invention. In FIGS. 5 and 6, a core 46 is maintained in position by means of a support 48. This support includes a detent 50 received within a correspondingly dimensioned opening defined by core 46. It will be appreciated that the presence of the support will substantially avoid deflection of the core relative to the cavity surfaces defined by mold 52.

Figure 7:
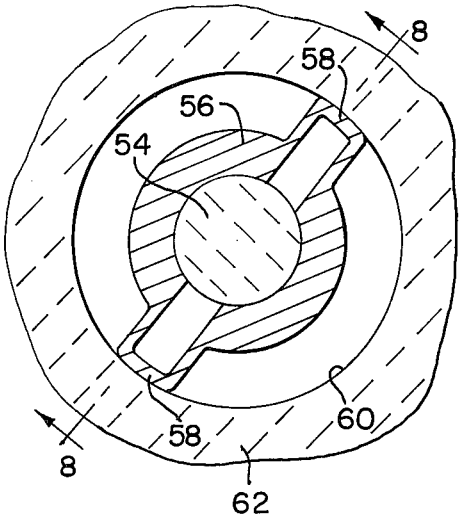
FIG. 7 is a cross-sectional view of a mold illustrating still another alternative form of core and core support; and, FIG. 8 is a vertical elevational view taken about the line 8—8 of FIG. 7.
Figure 8:
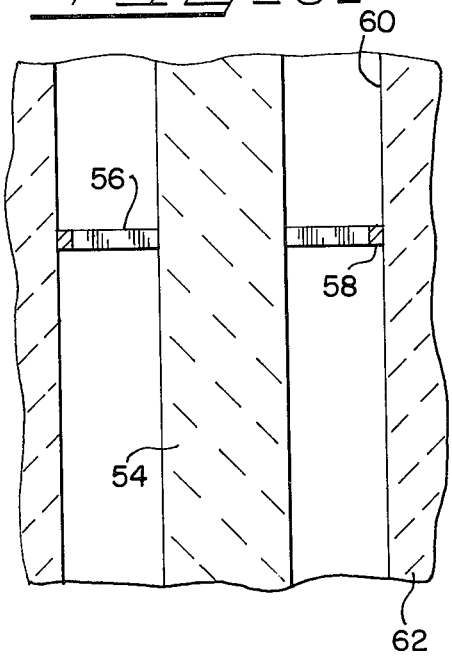

The support of FIGS. 5 and 6 is in substantially point contact with core 46 and in circumferential contact with the mold. In the arrangement of FIGS. 7 and 8, a core 54 is circumferentially engaged by a support 56. Oppositely directed portions 58 of the support contact the surface 60 defined by the internal passage of mold 62. This combination also substantially prevents any deflection of the core relative to the adjacent mold walls.

The embodiments shown in FIGS. 2 through 8 are intended only as illustrations since core supports of many different configurations could be employed depending upon the particular nature of the core involved. Many cores have openings or irregularities which readily lend themselves to the attachment of core supports, and the design of the supports will depend upon the configuration of such openings or irregularities. As a general proposition, however, any support configuration comprising a stud, wire, clip or the like is contemplated as long as this member can be positioned between a core and an adjacent mold wall to maintain precise spacing between the core and mold wall. When calculating support dimensions the relative thermal expansion characteristics of the materials involved are taken into consideration.

It is also contemplated that a support could be located between adjacent cores as illustrated in FIG. 2 whereby the support will maintain spacing between adjacent cores. Such core spacing supports may be integral with the support extending between the support and the mold wall or a completely independent core spacing support may be used.

Utilizing supports of relatively small dimension is also of interest from the standpoint of cost savings. Where platinum or other precious metals are used, it is naturally preferred that a minimum amount of metal be dissolved into the ultimate casting. Furthermore, casting properties could be affected where large amounts of non-alloy material are contained therein which provides an additional reason for minimizing the amount of material used for the supports.

Finally, it should also be noted that the supports of this invention are initially wholly contained within the pattern material, and are wholly contained within the mold cavity after pattern removal. Thus, there is no support material extending into the mold wall which occurs in the prior art systems utilizing chaplets and the like. The system of this invention thus uses less metal for providing core support which, as indicated, represents a cost savings. Furthermore, the supports of the invention do not dissolve within a mold wall thereby leaving a cavity in the mold wall to be filled with casting alloy. The prior art systems do leave such protruding cast portions which must be ground away or otherwise surface finished.

Furthermore, it has been found that such protruding cast portions tend to be bent or broken off during handling. If this occurs prior to heat treatment, the cold worked areas may initiate recrystallization and grain growths beyond an acceptable limit.

The system of this invention has particular utility with reference to casting procedures utilized for forming directionally solidified cast articles, particularly single crystal castings. In such procedures, a starter crystal is usually employed, and temperature gradients are applied so that all crystal growth will progress unidirectionally from a particular starting point. With supports of the type contemplated by this invention, the material forming the supports will very rapidly go into solution so that the presence of the supports will not interfere with the desired crystal growth. Chaplets and the like employed in the prior art include portions extending into the mold, and when these portions are melted, there is a tendency for the resulting opening in the mold wall to provide a nucleating or recrystallization area. This disrupts the desired grain growth pattern so that prior art techniques cannot be efficiently employed in the formation of single crystals and the like.

It will be understood that various changes and modifications may be made in the above described invention without departing from the spirit thereof particularly as defined in the following claims.

I claim:

1. In a method for investment casting of metal articles from the group consisting of turbine blades, vanes, and structures including such blades or vanes, the articles defining (producing a cast metal article which defines) at least one internal passage, said method comprising the steps of providing at least one core dimensioned in accordance with the dimensions of said passage, confining the core within a disposable pattern, forming a ceramic mold around the pattern whereby, when the pattern material is removed, a mold cavity is provided with the core positioned in the cavity, curing said mold, and casting metal into the cavity to form said article with said passage defined therein, the improvement comprising the steps of providing a support for said core, said support having at least one dimension corresponding with a desired wall thickness of the cast article, positioning said support on said core surface, thereafter forming said pattern material around said core to wholly contain said support within said pattern material, forming said ceramic mold around said pattern, and removing said pattern material, said support holding said core in position against displacement during said pattern removal and during subsequent mold curing and casting operations.

2. A method in accordance with claim 1 wherein said support is dissolved in said cast metal article upon casting of the metal into said cavity.

3. A method in accordance with claim 2 wherein said support comprises a metal element.

4. A method in accordance with claim 3 wherein said support is formed of platinum.

5. A method in accordance with claim 1 including the step of providing a support on opposite sides of said core.

6. A method in accordance with claim 1 including the step of providing a support adjacent the edge of a core.

7. A method in accordance with claim 1 wherein separate cores are located in spaced apart relationship within said cavity, and wherein a support extends between said cores to hold the cores against displacement relative to each other.

8. A method in accordance with claim 1 wherein said cast metal article is directionally solidified.

9. A method in accordance with claim 8 wherein said cast metal article comprises a single crystal.

10. In an investment casting mold assembly for use in the production of (a) cast metal articles from the group consisting of turbine blades, vanes and structures including such blades or vanes, the articles defining (wherein said article defines) at least one internal passage, said assembly including at least one core dimensioned in accordance with the dimensions of said passage, a mold cavity for receiving a disposable pattern surrounding said core, (and) said cavity being defined by a ceramic mold formed around the pattern whereby, when the pattern material is removed, (a) the mold cavity is provided with the core positioned in the cavity, the improvement comprising a support for supporting said core within said cavity during pattern removal and during subsequent mold curing and casting operations, said support having at least one dimension corresponding with a desired wall thickness of the cast article, said support being positioned on said core surface during forming of said pattern material around said core whereby the support is wholly contained within said (pattern material) mold cavity after the pattern material has been removed, there being no portion of the support extending into the ceramic mold.

11. A mold assembly in accordance with claim 10 wherein said support comprises a wire element.

12. A mold assembly in accordance with claim 11 wherein a plurality of cores are positioned in spaced relationship within said cavity, and wherein said wire element is woven between at least some of said cores to hold adjacent cores against displacement relative to each other.

13. A mold assembly in accordance with claim 10 wherein said support is adapted to be dissolved in said cast metal article upon casting of the metal into said cavity.

14. A mold assembly in accordance with claim 13 wherein said support comprises a metal element.

15. A mold assembly in accordance with claim 14 wherein said support is formed of platinum.

* * * * *

UNITED STATES PATENT OFFICE

CERTIFICATE OF CORRECTION

Patent No. 4,487,246 Dated December 11, 1984

Inventor(s) Donald J. Frazier

It is certified that error appears in the above-identified patent and that said Letters Patent are hereby corrected as shown below:

Column 6, line 7, "(producing a cast metal article which defines)"; line 50, "(a)"; line 53, "(wherein said article defines)"; line 57, "(and)"; line 59, "(a)"; and Column 7, line 1 "(pattern material)"; each of these expressions in "quotes" should be deleted.

Signed and Sealed this

*Seventh* Day of *January 1986*

[SEAL]

*Attest:*

DONALD J. QUIGG

*Attesting Officer*

*Commissioner of Patents and Trademarks*